US005594190A

United States Patent [19]

Malta

[11] Patent Number: 5,594,190

[45] Date of Patent: Jan. 14, 1997

[54] METHOD OF SUPPORTING HANDBELLS ON AN INFLATED TABLE COVERING PAD

[75] Inventor: Jacob H. Malta, New Britain, Pa.

[73] Assignee: Malmark, Inc., Plumsteadville, Pa.

[21] Appl. No.: 517,424

[22] Filed: Aug. 21, 1995

[51] Int. Cl.[6] ..... G10G 5/00

[52] U.S. Cl. ..... 84/453; 5/655.3

[58] Field of Search ..... 84/453, 406; 5/655.3–706, 5/711, 712; 150/154, 158

[56] References Cited

U.S. PATENT DOCUMENTS

| | | | |
|---|---|---|---|
| 585,834 | 7/1897 | Ruth | 5/711 |
| 2,465,268 | 3/1949 | Rogers et al. | 5/711 |
| 3,283,343 | 11/1966 | Worcester | 5/644 |
| 3,477,072 | 11/1969 | Frost | 5/710 |
| 4,459,714 | 7/1984 | Lin | 5/711 |
| 4,750,402 | 6/1988 | Markey | 84/453 |

*Primary Examiner*—Alexander Grosz
*Attorney, Agent, or Firm*—Gregory J. Gore

[57] ABSTRACT

A handbell table cover pad comprises inflatable cushions for providing a cushioned support for handbells resting on the top surface of the pad. The pads include valleys along their top surfaces which cradle the bells while placed on top of the cushions for locating and supporting the individual handbells. A plurality of internal ribs are joined between the inside surfaces of top and bottom panels to create the valleys. The material of the cushions is preferably a heavy-gauge PVC, cut into panels which are joined along airtight seams by ultrasonic welding. The inflatable pads may be spray coated with a self-adhering flock fiber which provides the look and feel of a soft fabric surface.

4 Claims, 2 Drawing Sheets

METHOD OF SUPPORTING HANDBELLS ON AN INFLATED TABLE COVERING PAD

FIELD OF THE INVENTION

The present invention relates to the field of accessories for musical instruments, namely handbell support structures. More specifically, it relates to the playing of handbells utilizing a cushioned table top support.

BACKGROUND OF THE INVENTION AND DESCRIPTION OF PRIOR ART

Handbells are typically played by a performer who selects from a number of bells which are picked up, rung, and then put down to rest. Handbells, while at rest, are generally supported by a covered padded table. An example of a handbell table cover which is well known is shown in U.S. Pat. No. 4,750,402. As disclosed in this patent and widely used are polyurethane foam pads of medium durometer having a thickness of between three-to-four inches. These pads are universally employed on table tops from which the handbells are rung. Handbell pads serve the dual purpose of providing both a cushion between the bell and the table top and, because of their open cell construction, a resonant chamber of entrapped air which amplifies certain lower frequencies when bells are laid down and plucked or malleted. Using another playing technique called "martellating", the bells are raised a few inches and then struck onto the pad surface providing a "stopped" sound effect.

The shortcoming of foam pads is that resonance is quickly dampened by the friction of air movement within individual cells in the foam. The volume of sound as well as resonance is also limited. Another major shortcoming is the large space occupied by their bulk, which is generally 30 inches by 36 inches by 4 inches. Choirs with five and six octaves of bells requiring ten or twelve table pads find storage and transportation difficult. Air travel by choirs with their performing equipment is especially made difficult for this reason.

It is therefore an object of the present invention to provide a handbell table cover which is collapsible so that it may be reduced in size for easy transportation and storage. It is another object of the present invention to provide a handbell table cover pad with enhanced sound transmitting characteristics. It is a further object of the present invention to provide a tunable handbell table cover pad which may be easily adjusted to alter the sound of a vibrating bell placed upon it. Other objects and advantages will become readily apparent to those of skill in the art from the following drawings and description of the invention.

SUMMARY OF THE INVENTION

The present invention solves the above-described problems of bulk and the overdamping of the vibrating musical handbell instruments. The air cushions are the same overall dimensions as standard pads except that they are inflatable. The material of the cushion is a heavy gauge PVC material constructed from panels joined by ultrasonic welding. The air may be applied by a simple closable port into which the installer blows expelled air from his lungs. Furthermore, the pressure of the air trapped in the cushions may be regulated to obtain different sound characteristics.

The air cushions may further include internal ribs which travel between opposing top and bottom surfaces so that when inflated, deep depressions or valleys are created along the top surface along the edges of the ribs. The valleys cradle the bells placed onto the top of the cushions and prevent their rolling out of position or falling from the surface of the pad. In addition, the surfaces of the inflatable pads may be spray coated with a self-adhering flocked fiber which provides them with the look and feel of a soft fabric surface.

More specifically, the invention comprises an inflatable handbell table cover having an inflated pad for covering a table top. The pad includes an internal air-filled void for providing a cushioned support for handbells resting on the top surface of the pad. The pads are constructed by permanently joining opposing horizontal top and bottom panels along their perimeters to vertical side panels along air-tight seams. A plurality of internal ribs are joined between the inside surfaces of the top and bottom panels. The height of the ribs are preferably less than the expanded free height of the top panel when inflated so that gathered valleys are created in the top panel along the top edges of the ribs.

DESCRIPTION OF THE PREFERRED EMBODIMENT

Figure 1:
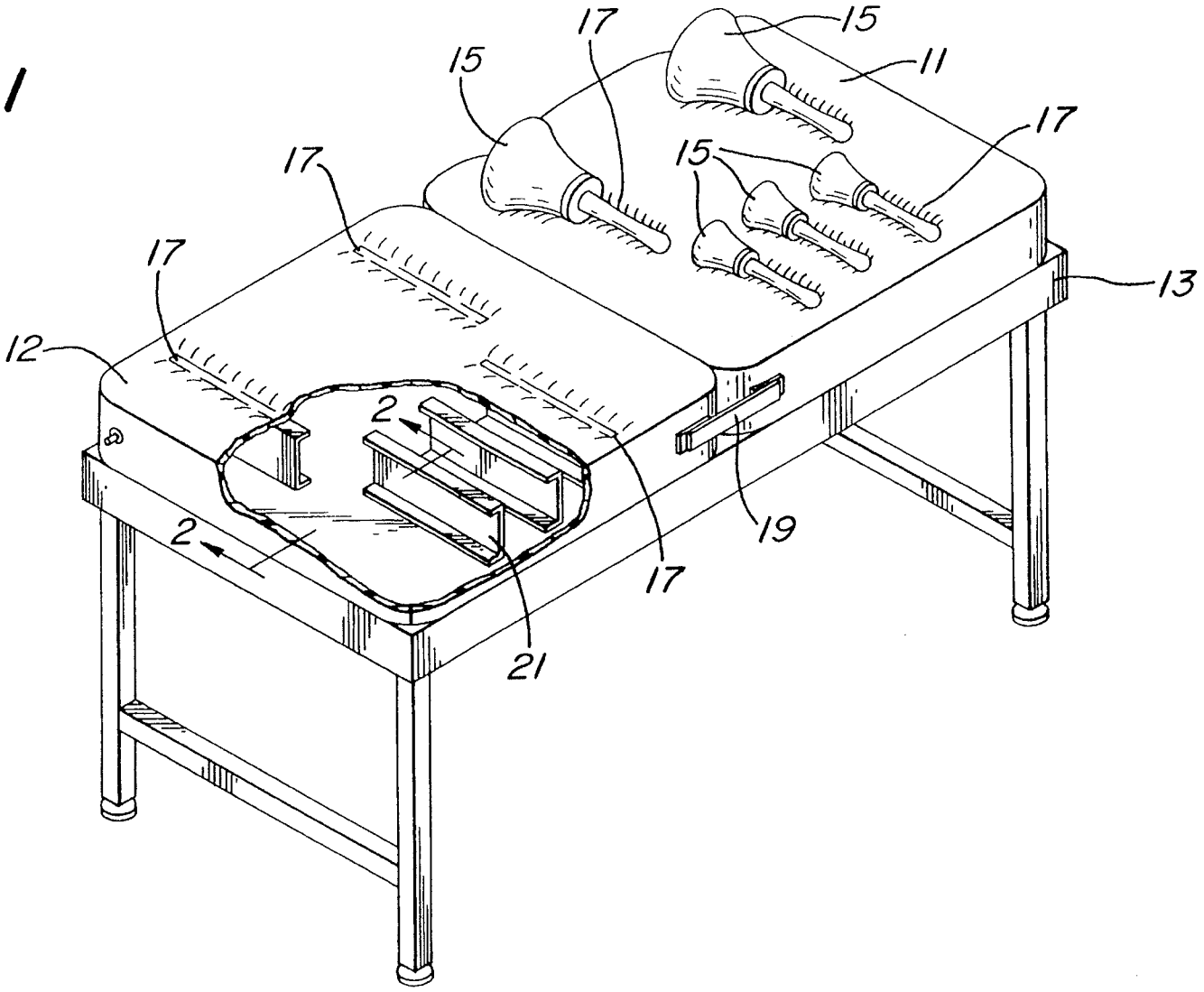
FIG. 1 is a top right rear isometric view of the table pad of the present invention.

Referring now to FIG. 1, the inflatable table cover, including pads 11 and 12, is shown installed onto the top of the handbell playing table 13. During a performance, a handbell ringer stands at the rear of the table as shown. The bells to be rung 15 are placed on the top of the table pad resting in the various depressions or valleys 17 located along the top surface of the cushion. As shown in this figure, a pair of individual pads 11 and 12 are aligned in abutting relationship, side by side, and interconnected by Velcro strips (only front facing strip 19 shown in this figure). Internal ribs 21 are connected between opposing separate top and bottom panels as shown more clearly in FIGS. 2 and 3.

Figure 2:
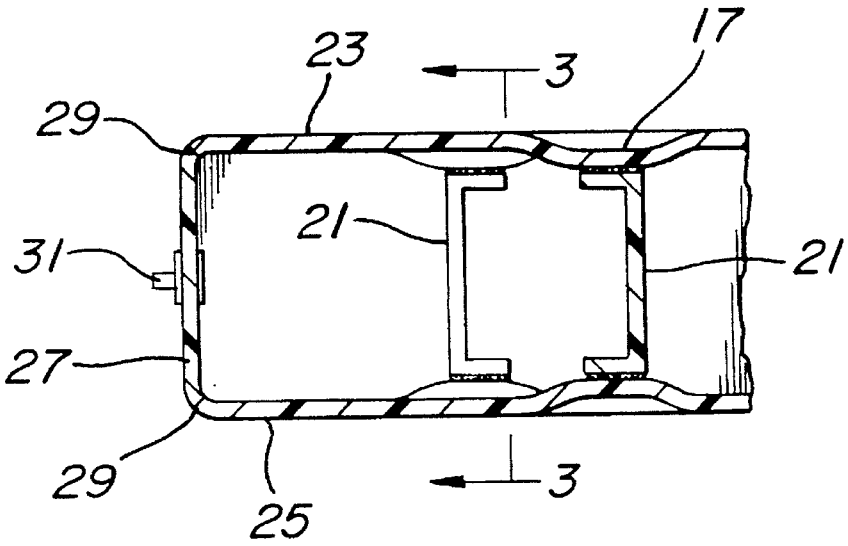
FIG. 2 is a sectional view taken from FIG. 1 as shown in that figure.

Referring now to FIG. 2, the internal construction of the cushion pads is shown. Each pad is constructed by joining opposing horizontal top and bottom panels 23 and 25, respectively, with vertical side panels 27 at seams 29 along their perimeters. The panels are composed of a heavy gauge PVC material and are joined along the air-tight seams, preferably by ultrasonic welding. The pads may be inflated by a simple air tube port 31 which receives air from the mouth of the installer who breathes into the tube. Alternatively, the pads may be inflated by a mechanical pump. Internal ribs 21 are located within the air-filled void inside the pads. The ribs 21 are shorter in vertical height than the expanded free height between the top and bottom panels 23 and 25 of the pads when inflated. This creates depressions or valleys 17 in the gathered, opposing outer surfaces of the pads to position the bells as shown in FIG. 1. The internal ribs may be any length and placed in any convenient location inside the pads. Preferably, the internal ribs do not abut the side panels of the pads for aesthetic reasons. As many valleys of varied depth and length as desired may be created by using additional ribs of varying dimension.

Figure 3:
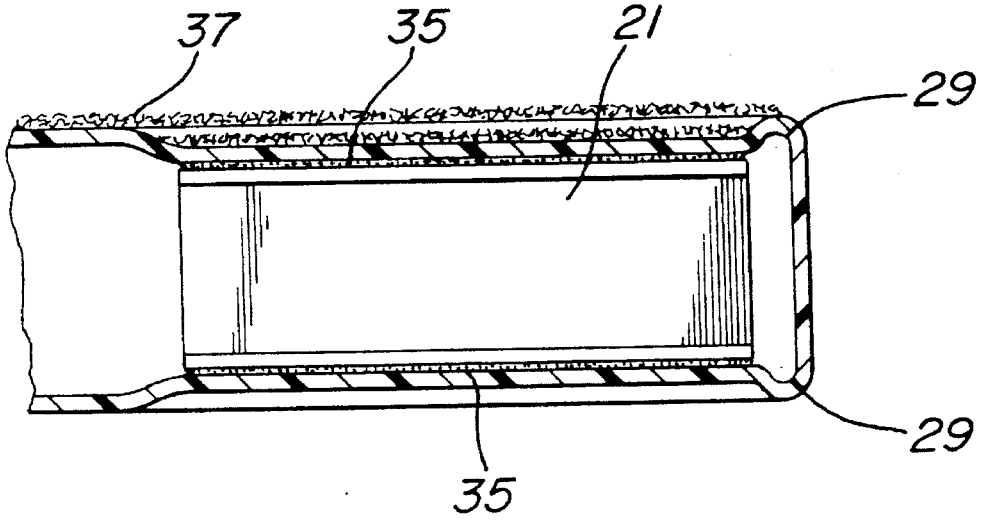
FIG. 3 is a sectional view taken from FIG. 2.

Referring now to FIG. 3, the pads are preferably constructed from heavy gauge PVC material which is ultrasonically welded at the seams 29 to create an air-tight inflatable internal volume. As an alternate material, PVC-lined canvas may be used with seams joined by means appropriate for that material. The internal ribs 21 are likewise ultrasonically welded along rib seams 35 to the opposing top and bottom panels in order to gather those surfaces closer together than the side panels. As described above, this creates valleys for positioning the bells when at rest. Finally, the pads may be covered with any suitable material, but a spray coating with self-adhering flocked fiber 37 is preferred.

Compared to foam pads, the air pads of the present invention contain a large volume of air which is relatively non-restricted in its vibration. Thereby, the resonance and amplification of the sound of bells struck and lying on the surface of the pad is greatly enhanced. Sound vibrations are also more directly transmitted to the table top by the greater contact surface area of the present bottom panel, compared with foam pads. Resonance and amplification are also controllable to a degree by increasing or decreasing the pressure of the air within the cushions which may be varied by trial and error as desired. This creates a "tunable" handbell pad. It will also be readily understood that the air cushion pads of the present invention practically eliminate the bulk of the present foam pads, since each air cushion pad can be quickly deflated for storage, transportation, or shipping.

It should be understood that the above description discloses specific embodiments of the present invention and are for purposes of illustration only. There may be other modifications and changes obvious to those of ordinary skill in the art which fall within the scope of the present invention which should be limited only by the following claims and their legal equivalents.

What is claimed is:

1. A method of supporting handbells on a table comprising the steps of:

a) positioning an inflated pad on the table, said pad including an internal air-filled void for providing a cushioned support for handbells resting upon a top surface of said pad;

opposing horizontal top and bottom panels of said pad affixed along their perimeter to vertical side panels, the outside surface of said top panel being said top surface; and, a plurality of internal ribs interconnected between inside surfaces of the top and bottom panels of said pad, the height of said ribs being less than the expands free height of said top panel when inflated, thus creating gathered valleys in said top panel for positioning said handbells;

b) positioning handbels on the top surface of said pad, adjacent said gathered valleys.

2. The method of claim 1, wherein said pad is constructed from heavy gauge PVC sheet material.

3. The method of claim 2, wherein said PVC sheet material is coated with a self-adhering flocked fiber.

4. The method of claim 2, wherein said panels are joined by ultrasonic welding.

* * * * *